US005222677A

United States Patent [19]

Sarfati

[11] Patent Number: 5,222,677

[45] Date of Patent: Jun. 29, 1993

[54] APPARATUS AND METHOD FOR THE DRAWING OFF OF THREADS, RIBBONS AND THE LIKE

[75] Inventor: Alberto G. Sarfati, Como, Italy

[73] Assignee: Sobrevin Société de brevets industriels-Etablissement, Vaduz, Liechtenstein

[21] Appl. No.: 715,444

[22] Filed: Jun. 14, 1991

[30] Foreign Application Priority Data

Jul. 12, 1990 [DE] Fed. Rep. of Germany ..... 4022277

[51] Int. Cl.[5] ..... B65H 49/02; B65H 49/06

[52] U.S. Cl. ..... 242/54 R; 242/129; 242/129.5; 242/129.7; 242/130; 242/134; 242/140; 242/141; 242/170

[58] Field of Search ..... 242/128, 54 R, 129, 242/129.5, 129.7, 129.72, 130, 131, 131.1, 134, 137, 137.1, 138, 140, 141, 146, 170, 171, 159

[56] References Cited

U.S. PATENT DOCUMENTS

| | | | |
|---|---|---|---|
| 2,429,798 | 10/1947 | Bradnack et al. | 242/131 |
| 2,558,808 | 7/1951 | Becker | 242/128 |
| 3,172,616 | 3/1965 | Hansen | 242/128 |
| 4,580,399 | 4/1986 | Henrich | 242/128 |
| 4,673,140 | 6/1987 | Boles | 242/54 R |

FOREIGN PATENT DOCUMENTS 1635899 2/1972 Fed. Rep. of Germany .

*Primary Examiner*—Stanley N. Gilreath
*Attorney, Agent, or Firm*—Martin A. Farber

[57] ABSTRACT

A device for drawing a thread, ribbon or the like off from a package (1), in which the thread or the like can be withdrawn overhead from the package and, in order to obtain a practically twist-free drawing off of the thread, ribbon or the like, the thread, ribbon or the like is withdrawn alternately over one of the two opposite end surfaces (1', 1'') of the package (1).

15 Claims, 4 Drawing Sheets

APPARATUS AND METHOD FOR THE DRAWING OFF OF THREADS, RIBBONS AND THE LIKE

FIELD AND BACKGROUND OF THE INVENTION

The present invention relates to a device for the drawing off of a material such as a thread, ribbon or the like from a package of the material. Hereinafter the term thread is to be understood to refer to thread, ribbon or the like.

Such devices have been known for a long time and are used on textile machines. For example, German Patent 1,635,899 discloses a device of this type in which the thread is withdrawn overhead (overend) through a draw-off eye of the package of thread. This thread draw-off device has the disadvantage that the twisting of the thread by 360° which takes place after each turn of thread which has been drawn off, imparts a considerable twist to the entire thread, ribbon or the like withdrawn. The number of turns is dependent on the diameter of the package of thread and on the length of thread withdrawn. Particularly upon the drawing off of ribbons, kinks are frequently formed in the thread, and thus disturbances in operation, for instance of the thread storage means arranged behind the thread- draw-off device.

SUMMARY OF THE INVENTION

The object of the present invention, therefore, is so to improve a draw-off device of the type in question that the twist imparted to the thread (or other material) drawn off is reduced up to complete cancellation of the twist. Another object of the invention is to provide a method, for the twist-free drawing off of thread or other material.

As a result of the development of the invention, there is provided thread draw-off device with which the thread can be drawn off alternately over one of the two end surfaces of the package of thread. In this connection, a draw-off eye or the like can be shifted in each case to the other opposite draw-off position after each turn has been drawn off, or the shifting of the draw-off eye between the two draw-off positions can take place after several turns have been drawn off, possibly also periodically. The thread package is preferably supported, with impeded rotation, by a holding device. The draw-off points are opposite each other and form the poles of an axis of the support. A thread package is so mounted by a holding device for the drawing off of the thread that it is aligned approximately parallel to the axis of the support. The thread is then drawn off overhead (overend) alternately from the package of thread from a draw-off point. By this measure, the resultant twist after the drawing off of a number of turns is at least partially counteracted and possibly completely cancelled out by a twisting in opposite direction of rotation upon the drawing off at the opposite end side. With the periodic change of the draw-off side, the resultant twists in each case can cancel each other out, averaged over time. The holding device for the package of thread preferably consists of a support bed which is curved concave to the axis of the support. The package of thread can lie in this curvature so that, due to gravity, it cannot roll out while as a result of the friction, it cannot be shifted in axial direction. The support bed is, in this connection, preferably developed as a cloth which supports the package of thread in a curvature.

Upon the drawing off of each turn, the thread is pulled through once between the support bed and the package of thread. The supporting of the package of thread can be made more certain in the manner that the support bed is formed of a plurality of supporting ribs which are arranged transverse to the longitudinal axis and parallel alongside of each other and are curved convexly around the support axis. A further improvement of the invention provides that the support ribs are formed of narrow, preferably elastic wire spirals or bristles which, curved around the support axis, form a trough-like grid on which the package of thread lies. A development of the holding device in the form of two supporting beams arranged parallel to the support shaft is furthermore preferred. The package of thread is then mounted on the upper edges of the beams. This development has the advantage, for instance, that the thread need in each case only be pulled between one beam and the package of thread while the package of thread can rest fully on the other beam. Rotation of the package of thread is thereby effectively prevented. The alternation of the opposite draw-off points furthermore has the result that any possible axial displacement of the package of thread upon the drawing off of the thread is equalized on average. A more uniform drawing of the thread from the package of thread can be obtained in the manner that the support beams are provided at their upper edges with air outlet nozzles through which air emerges to form an air cushion on which the package of thread floats. For the displacement of a draw-off eye, a swing arm is provided which can be swung around an axis of swing which is perpendicular to the longitudinal axis. The range of swing is preferably about 180., so that the swing arm can be displaced from the one axial pole position to the opposite pole position and the direction of the drawing off of the thread is aligned in each case with the lengthwise direction of the package of thread. Downstream of the thread draw-off eye seen in the direction of travel of the thread, there is a guide eye which is fixed in space and which is at equal distance from the two opposite draw-off places. The guide eye is preferably arranged opposite the axis of swing of a swing arm.

The swing hinge of the swing arm is preferably arranged below the holding device for the thread package. As a result of this development, it is possible for the thread to be withdrawn alternately over each of the two ends, a draw-off eye or the like being shifted alternately from the one draw-off position to the other.

BRIEF DESCRIPTION OF THE DRAWINGS

The invention will be described in detail with reference to embodiments shown in FIGS. 1 to 6 of the drawings, in which.

DETAILED DESCRIPTION OF THE PREFERRED EMBODIMENTS

Figure 1:
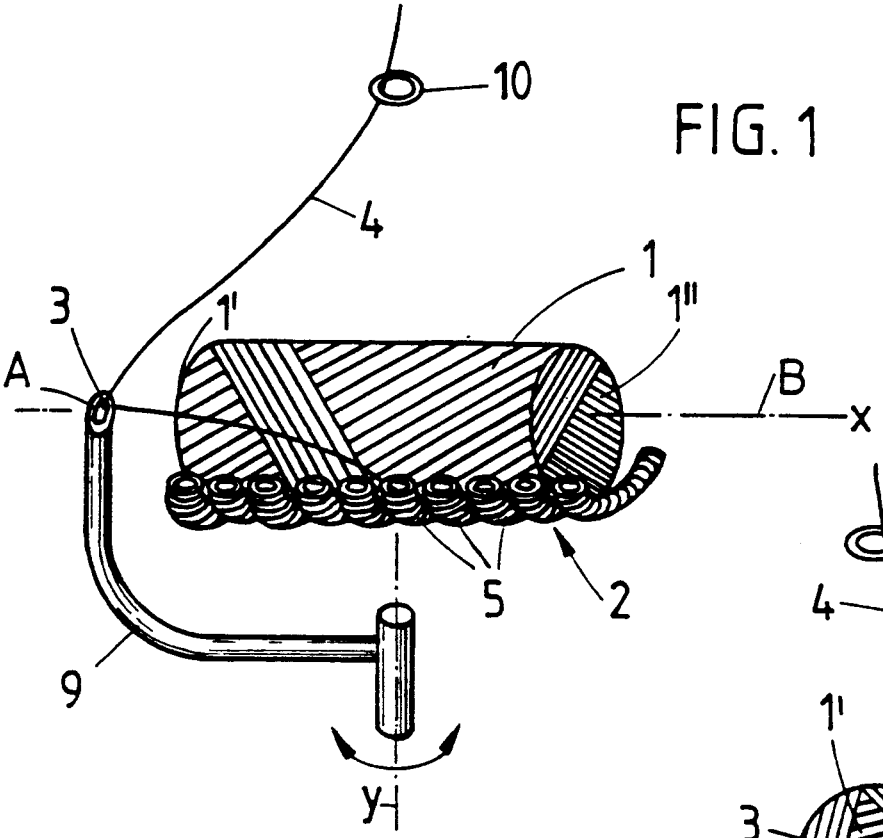
FIG. 1 is a side view of a thread draw-off device with the draw-off eye in draw-off position A.
Figure 2:
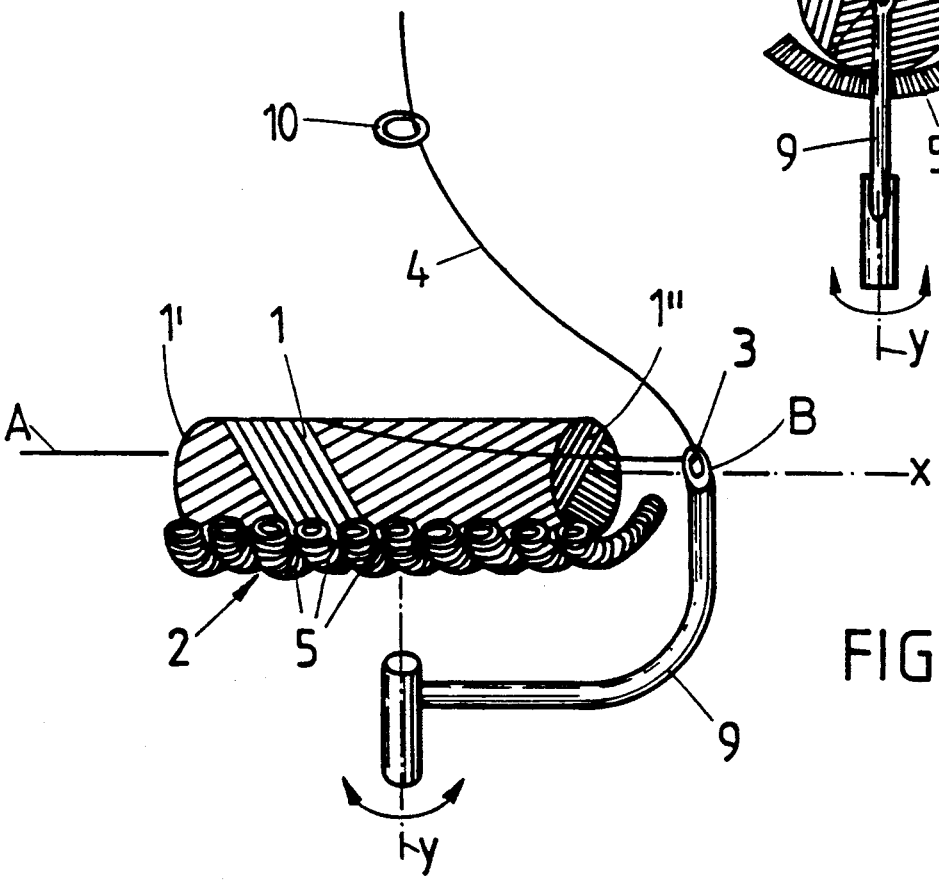
FIG. 2 is a showing similar to FIG. 1 with the draw-off eye in draw-off position B.

The thread draw-off device shown FIG. 1 comprises a holding device 2 and a swing arm 9 which is swingable around a swing axis y and has a draw-off eye 3 at its end. The holding device has a longitudinal axis x around which the support bed, formed of a plurality of support ribs 5 arranged parallel to and alongside each other, is concavely arched. In the concave curvature of the support bed 2, a thread package 1 can be supported, as shown. The cylindrical or conically shaped thread package 1 lies in its lengthwise direction approximately parallel to the support axis x in such a manner that its end surfaces 1', " are each directed towards the poles (opposite points) of the support axis x. The central axis of a conically shaped thread package can in this connection also intersect the support axis x.

The support ribs 5 are developed in this embodiment as wire spirals so that movement of rotation of the thread package is impeded by friction. The wire turns are arranged so closely alongside of each other that clamping of the thread therein is avoided.

Figure 3:
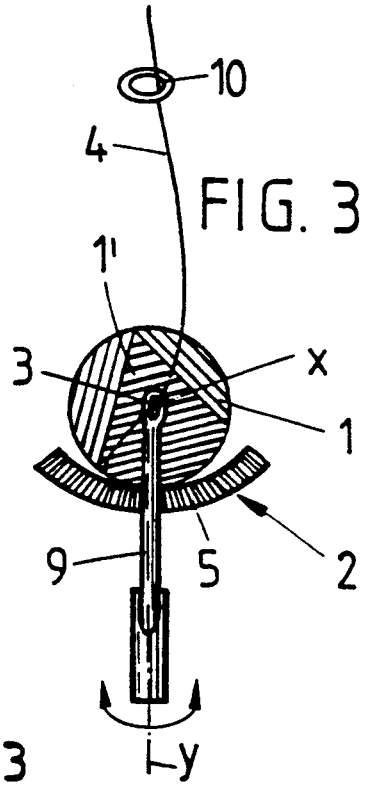
FIG. 3 is a left side view of FIG. 1.
Figure 3A:
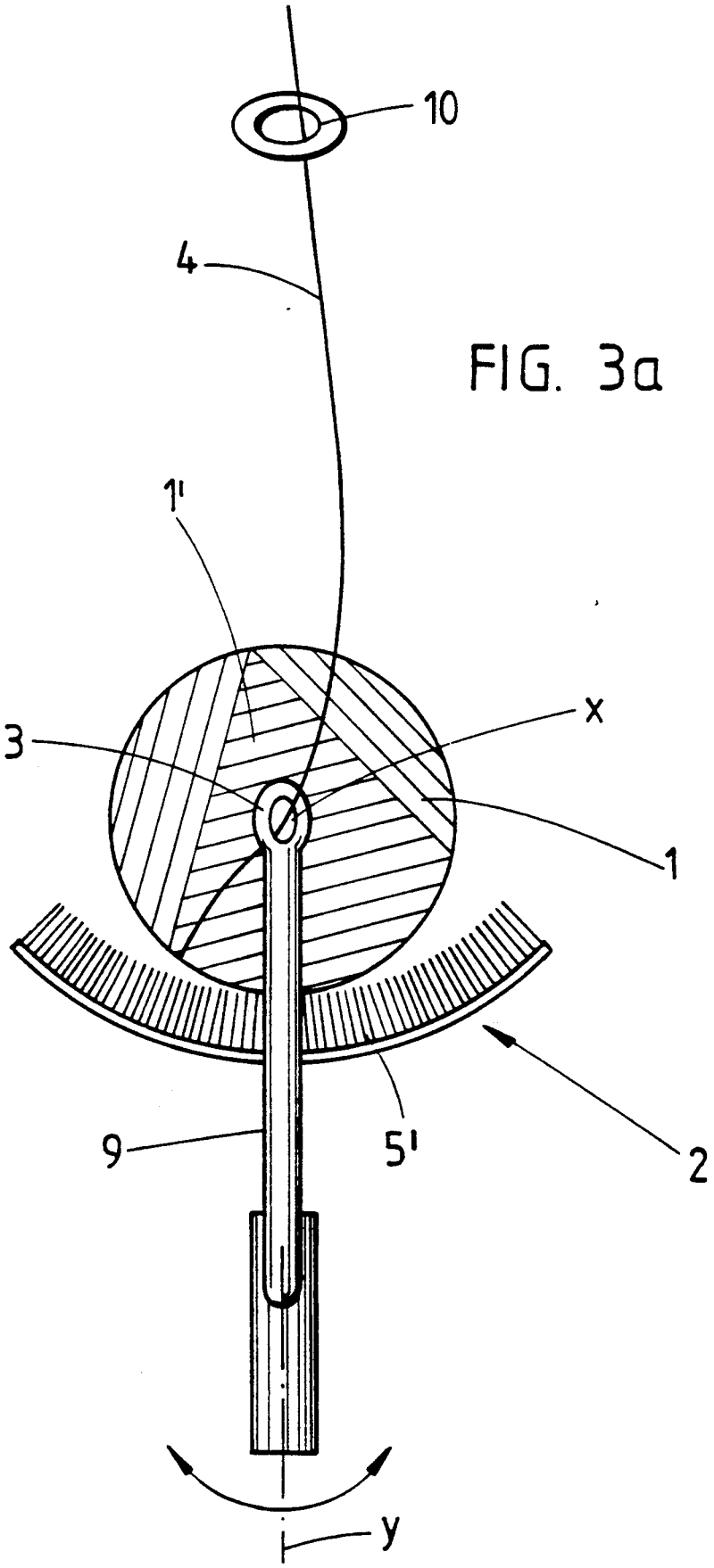
FIG. 3*a* is a view similar to FIG. 3 showing bristles supporting the thread package.

FIG. 3*a* shows a strip of bristles 5= supporting the thread package 1.

The swing joint of the swing arm 9 which is swingable around the axis of swing y is located below the support bed 2 in such a manner that the axis of swing y intersects the x axis. The swing arm 9 can be swung 180° from a position A which corresponds to the one pole of the support axis x so that it assumes an opposite draw-off position B which corresponds to the other pole of the support axis. The thread is in each case withdrawn through the draw-off eye 3.

A stationary guide eye 10 is arranged downstream of the draw-off eye as seen in the direction of travel of the thread, at an equal distance between the draw-off points A, B above the support bed. The draw-off eye 3 and the swing arm arm 9 comprise a guide means by which the withdrawn material (thread, ribbon or the like) is guided.

Figure 4:
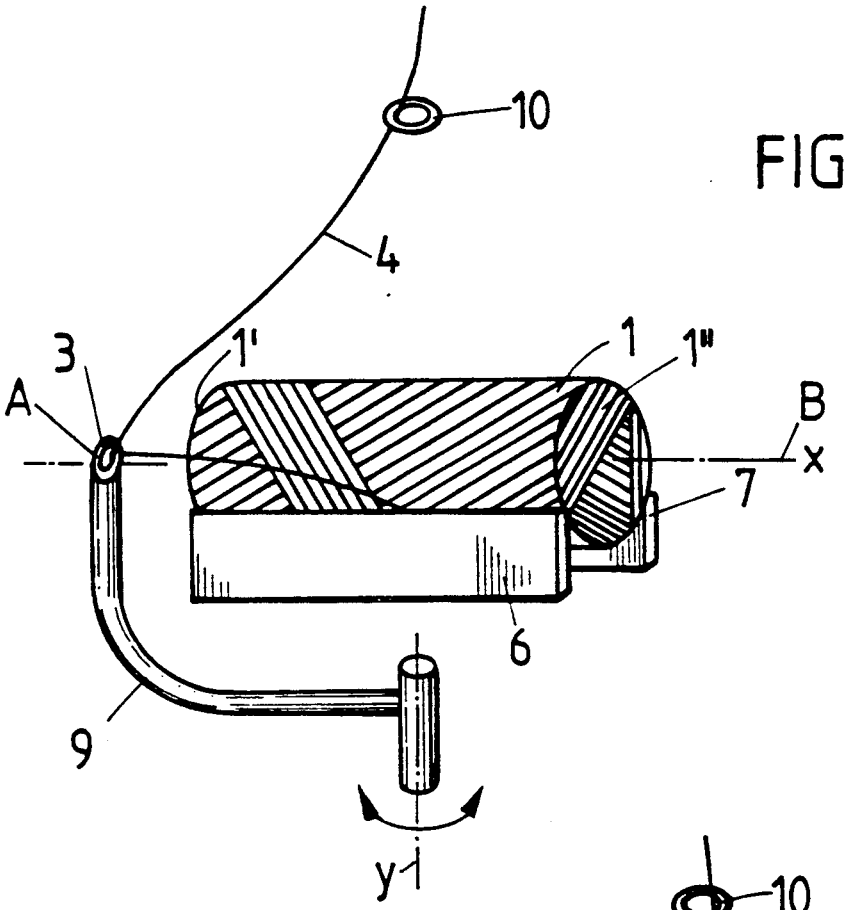
FIG. 4 is a view in accordance with FIG. 1 of a second embodiment.
Figure 5:
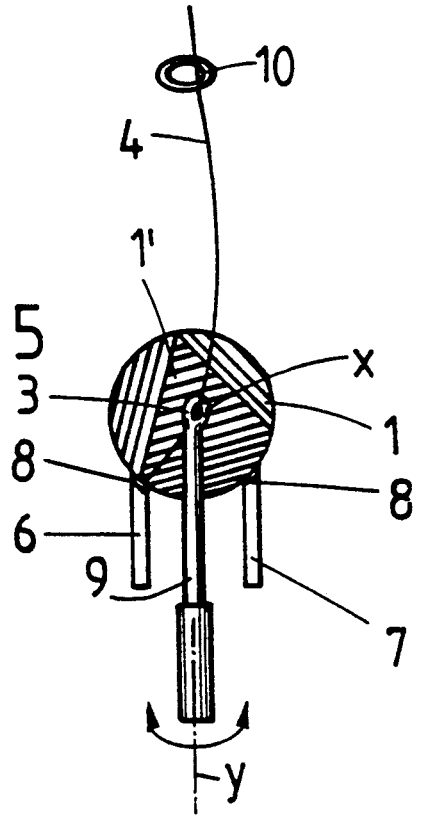
FIG. 5 is a view according to FIG. 3 of a second embodiment.

Another development of the invention is shown in FIGS. 4 and 5. In this case, the holding means 2 is formed of two support beams 6, 7 which extend parallel to the support axis x. The bobbin of thread 1 lies on the upper edges of the two support beams 6, 7 so that a thread 4, upon its withdrawal over one of the two end surfaces 1', 1", is in each case first of all pulled between the one beam 6 and the thread package 1 while the thread package 1 lies on the other beam 7. This increases the reliability of the support of the thread package on the holding means.

It is furthermore contemplated that the package of thread be supported on an air cushion. For this purpose, the support beams 6, 7 are provided at their upper edges with air outlet nozzles 8 from which air can emerge in the direction towards the surface of the thread bobbin 1. The jet of air emerging from the air outlet nozzles 8 then lifts the package of thread 1 off from the support beam so that the thread 4 can be drawn off without friction.

Figure 6:
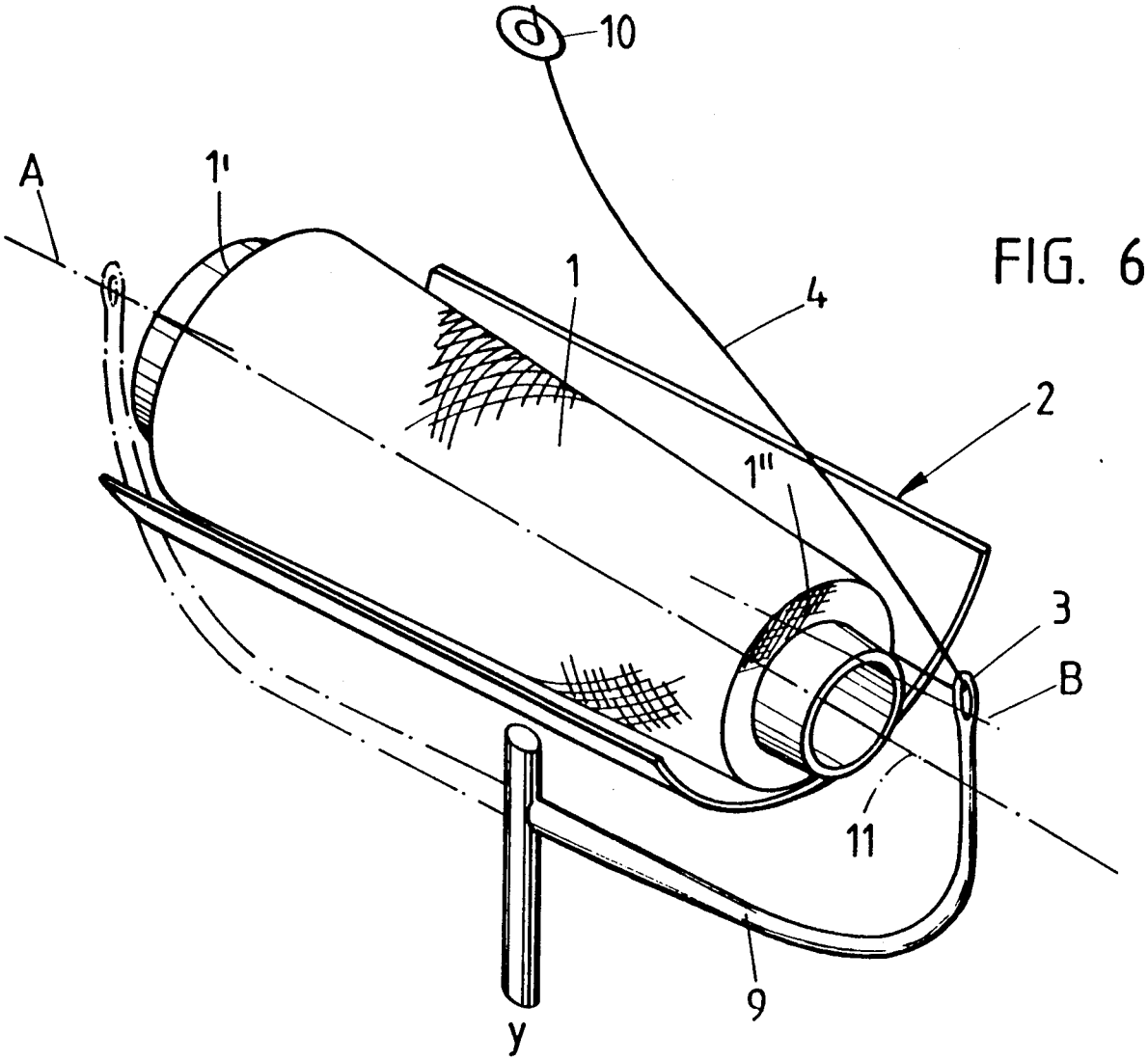
FIG. 6 is a view in perspective of another embodiment.

In the embodiment shown in FIG. 6, a conical thread package 1 lies in a holding means consisting of a cloth, which may be of fabric. The holding means 2 formed by the cloth forms a curvature for the supporting of the thread package 1 in a manner which impedes rotation. Otherwise, what has been said with regard to the embodiments described above applies also to this embodiment.

I claim:

1. A device for drawing off a material such as thread, ribbon and the like from a wound package, the material being drawn off overend from the package, wherein the package has two end surfaces which are opposite from each other, and guide means mounted for relative displacement with respect to the two end surfaces of the package for alternately guiding the material over respective ones of the two end surfaces of the package during withdrawal of the material from the package.

2. A draw-off device according to claim 1, further comprising holding means for supporting the package and impeding the package from rotation.

3. A draw-off device according to claim 2, wherein said holding means defines a support axis, and said guide means comprises a draw-off eye which is displaceably mounted between two draw-off points which are associated with opposite points of said support axis.

4. A draw-off device according to claim 3, wherein the package is supportedly aligned parallel to the support axis.

5. A draw-off device according to claim 2, wherein said holding means comprises a support bed having a concave curvature extending in a draw-off direction of the material.

6. A draw-off device according to claim 5, wherein the support bed is a cloth, the package being supported on the cloth forming said curvature.

7. A draw-off device according to claim 5, wherein said holding means defines a support axis, and said support bed is formed of a plurality of support ribs which are arranged parallel to and alongside each other transverse to said support axis and are curved concavely with respect to the support axis.

8. A draw-off device according to claim 7, wherein said support ribs are formed of wire spirals.

9. A draw-off device according to claim 2, wherein said holding means is formed of strips of bristles.

10. A draw-off device according to claim 2, wherein said holding means defines a support axis, and said holding means is formed of two support beams arranged parallel to the support axis.

11. A draw-off device according to claim 10, wherein said support beam have air outlet nozzles at their upper edges adjacent said thread package.

12. A draw-off device according to claim 3, wherein said guide means comprises a swing arm which is swingable around an axis of swing arranged perpendicular to said support axis, and said draw-off eye is on said swing arm.

13. A draw-off device according to claim 3, further comprising a stationary guide eye which is arranged in a draw-off direction of the material downstream of the draw-off eye and at an equal from the two draw-off points.

14. A draw-off device according to claim 2, wherein said holding means supports the package on a side of the latter between said two end surfaces.

15. A method for drawing off a material such as thread, ribbon and the like from a resting, wound package comprising the steps of supporting a wound package between two end surfaces of the package, and alternately withdrawing the material over respective ones of the two end surfaces of the package.

* * * * *